US006279482B1

(12) United States Patent
Smith et al.

(10) Patent No.: US 6,279,482 B1
(45) Date of Patent: Aug. 28, 2001

(54) COUNTERMEASURE APPARATUS FOR DEPLOYING INTERCEPTOR ELEMENTS FROM A SPIN STABILIZED ROCKET

(75) Inventors: David P. Smith, Pacific Palisades; Jane M. Lin, Rancho Palos Verdes, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 08/961,900

(22) Filed: Oct. 31, 1997

Related U.S. Application Data

(63) Continuation-in-part of application No. 08/687,877, filed on Jul. 25, 1996, now abandoned.

(51) Int. Cl.[7] ..... F42B 12/60

(52) U.S. Cl. ..... 102/374; 102/357; 102/393; 102/474; 102/489; 102/494; 89/1.11

(58) Field of Search ..... 102/340, 342, 102/351, 357, 374, 393, 405, 474, 480, 489, 491–497, 505, 703; 89/1.11

(56) References Cited

U.S. PATENT DOCUMENTS

| | | | | |
|---|---|---|---|---|
| 810,582 | | 1/1906 | Stout . | |
| 1,042,176 | | 10/1912 | Voller . | |
| 1,211,936 | * | 1/1917 | Gunter et al. | 102/480 |
| 3,093,072 | | 6/1963 | Pigman | 102/7.2 |
| 3,095,814 | | 7/1963 | Jansen et al. | 102/49 |
| 3,380,687 | | 4/1968 | Wrench et al. | 244/1 |
| 3,741,125 | * | 6/1973 | La Pointe | 102/489 |
| 3,898,661 | | 8/1975 | Kelly et al. | 343/18 E |
| 3,956,990 | * | 5/1976 | Rowe | 102/703 |
| 4,072,107 | | 2/1978 | Saxe et al. | 102/4 |
| 4,080,900 | * | 3/1978 | Augenstein et al. | 102/495 |
| 4,175,469 | | 11/1979 | Ritland et al. | 89/1 B |
| 4,210,082 | | 7/1980 | Brothers | 102/8 |
| 4,388,869 | * | 6/1983 | Edleson | 102/494 |
| 4,388,870 | * | 6/1983 | Edelson | 102/494 |
| 4,406,227 | | 9/1983 | Beeker et al. | 102/505 |
| 4,638,737 | * | 1/1987 | McIngvale | 102/489 |

(List continued on next page.)

FOREIGN PATENT DOCUMENTS

| | | | | |
|---|---|---|---|---|
| 3343515 | * | 6/1985 | (DE) | 102/489 |
| 550001 | * | 12/1942 | (GB) | 102/494 |
| 1085045 | * | 9/1967 | (GB) | 102/494 |

OTHER PUBLICATIONS

"Sky Guard Fire Control /35mm Twin Gun Air Defense System Demostration" , Firing Range Allintsteig, Austria, Sep. 12/22, 1993.*

Contraves Sales and Technical Brochure, "The lethal blow to any missile or other airborne threat", Contraves, Pittsburgh, PA 15238, 5 pages.

*Primary Examiner*—Harold J. Tudor
(74) *Attorney, Agent, or Firm*—Robert W. Keller

(57) ABSTRACT

There is provided a countermeasure defense system against hostile missiles by employing non-explosive intercepting ("NEI") elements 14 deployed by the spin stabilized rocket 10. The NEI are carried in a payload section 17 and contained by a sleeve assembly 16 which is removed by a drive mechanism 20 or a pyrotechnic device 152 after a countdown time delay programmed into the trigger release assembly 46 as controlled by the control unit 150. The drive assembly includes a drive rod 26 that is releasably held by a release assembly 46 a compressed coiled spring unit 30 drives the sleeve assembly 16 forward exposing the payload section 17 to the centrifugal force of the spin stabilized rocket propelling the NEI elements out from the rocket at constant angular velocity creating an interceptor cloud of elements. In another embodiment the pyrotechnic device 152 detaches the shearable screws 170 that secure the payload section 117 from the rocket engine housing 102 thereby setting the sleeve 121 free from the rocket housing 102.

16 Claims, 3 Drawing Sheets

U.S. PATENT DOCUMENTS

| | | | | |
|---|---|---|---|---|
| 4,658,727 | | 4/1987 | Wilhelm et al. | 102/494 |
| 4,676,167 | | 6/1987 | Huber, Jr. et al. | 102/393 |
| 4,770,101 | * | 9/1988 | Robertson et al. | 102/489 |
| 4,922,827 | | 5/1990 | Remo | 102/496 |
| 4,947,754 | * | 8/1990 | LaRocca | 89/1.11 |
| 4,960,055 | * | 10/1990 | Dieval | 102/489 |
| 5,005,483 | * | 4/1991 | Deffayet | 102/489 |
| 5,040,465 | * | 8/1991 | Maury | 102/357 |
| 5,253,587 | * | 10/1993 | Thouron et al. | 102/489 |
| 5,322,016 | | 6/1994 | Toth | 102/211 |
| 5,431,106 | * | 7/1995 | Dunn et al. | 102/489 |
| 5,464,174 | | 11/1995 | Laures | 244/3.11 |
| 5,864,086 | * | 1/1999 | Ettmuller | 102/489 |

* cited by examiner

COUNTERMEASURE APPARATUS FOR DEPLOYING INTERCEPTOR ELEMENTS FROM A SPIN STABILIZED ROCKET

CROSS-REFERENCE TO RELATED APPLICATION

This application is a continuation-in-part of U.S. patent application Ser. No. 08/687,877 filed Jul. 25, 1996 (now abandoned).

BACKGROUND

This invention relates to countermeasures for killing a hostile missile and more particularly to the deployment of non-explosive interceptor elements ("NEI") deployed in the direct path of an incoming hostile missile from a spin stabilized rocket.

Battlefield engagements involving such weaponry as tanks, mobile artillery vehicles and other artillery pieces are vulnerable to attack by enemy armor-destroying missiles. Defensive countermeasures to neutralize or kill such incoming hostile attacks generally utilize explosive means for destroying the hostile missile and as a result pose a threat to friendly military personnel in the battle zone. Currently available countermeasure systems which involve guided missiles are costly and complicated to construct and, above all, the use of explosives as a countermeasure offer the potential of harming friendly military personnel. The use of countermeasures activated by proximity fuses are particularly hazardous to friendly military personnel. What is needed is an active defense system that itself is not explosive and yet will effectively intercept and kill an incoming guided missile using NEI which will at least lessen or decrease the hazard to friendly military personnel in the vicinity.

Known defensive systems, such as U.S. Pat. No. 4,388,869 are deserving of comment. The teachings in this patent involve the use of non-explosive rods and pellets which are strewn in the orbital path of a satellite target moving in outer space. The targeted spacecraft is engaged and destroyed by the colliding and penetrating rods. The deficiency of such known systems is the ability to deploy the interceptors at precise time and in a controlled array such as a cloud of interceptors to effectively destroy the hostile missile. Other defense systems employ automatic guns that fire projectiles containing heavy metal shrapnel-like elements. A time delay fuse sets off an explosive charge that randomly sprays the shrapnel and subprojectiles against the hostile missile. Unlike the present invention the subprojectiles and shrapnel-like particles pose a hazard to friendly military personnel. Other known countermeasure techniques involve the use of guided missiles that are triggered by a contact fuse or otherwise guided by optical sensors to engage the incoming hostile missile. It has been found that the high probability of successfully defending against such hostile guided missiles is the creation of a cloud of NEI which are deployed directly in the trajectory path at a precise time and in a controlled pattern to assure collision and destruction.

SUMMARY

In accordance with the teachings of the present invention an airborne apparatus is provided that is directed along an interception path for dispensing a plurality of non-explosive interceptor ("NEI") elements in a predetermined configuration to generate a continuous cloud which is directly in the path of the oncoming hostile missile. The apparatus is in the form of a spin stabilized rocket having a longitudinal axis, a rearward end, a lead end, a nose cone body, and a payload section intermediate said nose cone and the rearward end, said payload being disposed circumferentially about the longitudinal axis of the rocket. The payload is comprised of a supply of NEI elements which are propelled from the payload section at a constant tangential velocity in response to the centrifugal force produced by the spin rate of the spin stabilized rocket in flight. In one preferred embodiment the release mechanism for the NEI comprises a slidably driver sleeve assembly. Release means is provided in the form of a slidably driven sleeve assembly that covers the payload section during flight and releasing the NEI elements when the sleeve assembly is retracted from the rearward end to the lead end exposing the payload section free of containment. Dispersing the NEI elements forms an interceptor cloud. The cloud is precisely deployed directly in the trajectory path to stop the hostile missile.

In one preferred embodiment, the interceptors may be contained in a series of tube structures arranged radially about the longitudinal axis propelling the NEI elements in a particular formation by the centrifugal force of the spin stabilized rocket which generates a particularly shaped interceptor cloud.

In another preferred embodiment the NEI elements are randomly placed in the payload section so that deployment at the precise time forms a controlled cloud of air borne elements in the intercepting path of hostile missile.

In a still further preferred embodiment the release mechanism for the payload is maintained in a stored condition by a sleeve assembly that is releasably secured to the rocket engine housing by shearable screws. The payload section is opened by pyrotechnic devices actuated by a timing delay control unit that releases the NEI to generate the interceptor cloud directly in the path of the incoming trajectory of the hostile missile. The pyrotechnic devices are positioned between the nose cone section and the payload section to generate the required thrust shearing the bolts without disturbing the array of NEI charged into the payload section. There is provided a thrust bar centrally positioned within the payload section that directs the pyrotechnic force load path to the rocket engine housing without applying compacting loads to the NEI elements. The pyrotechnic forces shear the screws restraining the sleeve and allow the release of the otherwise undisturbed NEI elements.

The form of the NEI is preferably spherical and arranged in the payload section in a hexagonal stacking arrangement in which the successive layers are added with the NEI tangentially in contact with one another. The NEI to advantage may be cylindrically shaped or of an irregular shape and still create an effective interceptor cloud.

DRAWINGS

These and other features, aspects and advantages of the present invention will become better understood from the following description, appended claims, and accompanying drawings where:

DESCRIPTION

This invention is directed to a defensive countermeasure apparatus. In one embodiment the rocket identified generally with the numeral 10 can be used to protect weaponry such as tanks and other mobile vehicles such as artillery pieces to be defended against guided missiles. Such countermeasure apparatus desirably should intercept the incoming missile in a manner that presents a minimal hazard to friendly military personnel in the battle zone. The use of explosive countermeasures against hostile missiles that depend on a contact fuse or proximity fuse to explode the defending apparatus in the vicinity of the incoming missile poses a recognized hazard to friendly military personnel operating in the targeted battle zone. Hence, the defense system of this invention employs NEI elements which at least will reduce that hazard.

The construction and operation of the countermeasure apparatus is much less costly to produce because of the unique mechanical arrangement used to deploy the NEI at the predetermined instant it encounters the incoming hostile missile. The tracking of the hostile missile is accomplished with a W-band 94 Ghz radar set and the radar set also operates to command the firing of the countermeasure missile and updates the countdown time delay timer for deploying the NEI.

Figure 1:
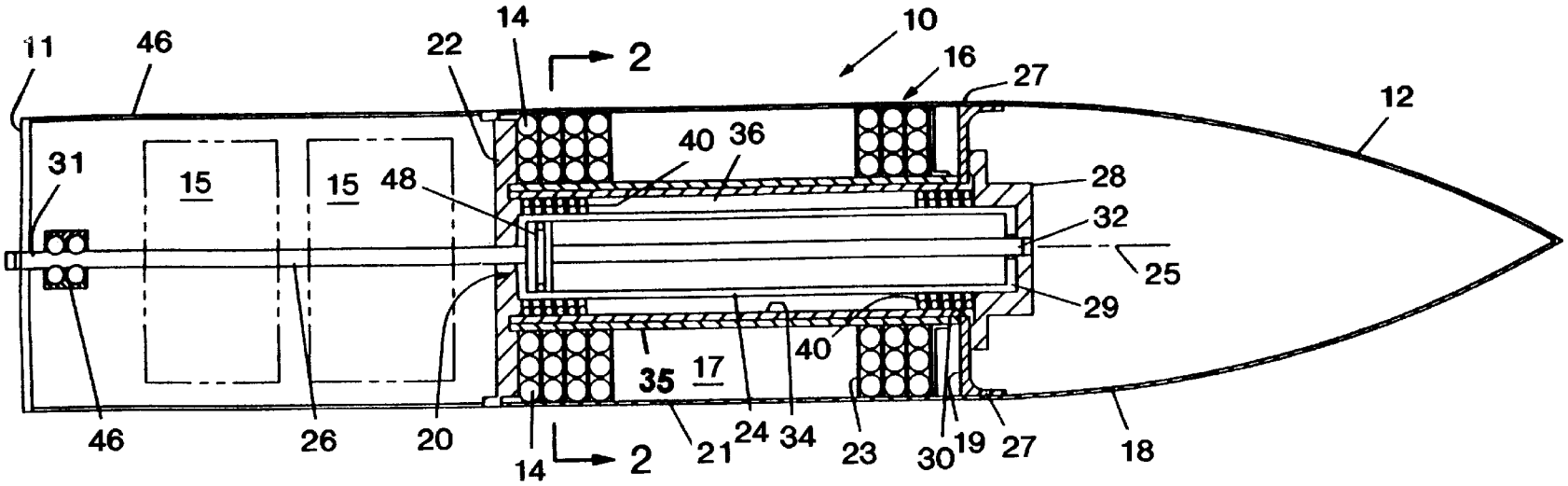
FIG. 1 is a longitudinal cross-section of the defending countermeasure rocket showing the containment of the NEI elements in the payload section.

The defense system of this invention, as shown in FIG. 1, is a spin stabilized rocket 10 spinning at about 10,000 to 11,000 rpm. The rocket has a rearward end 11 and a lead end 12 and is adapted to carry a deployable supply of NEI elements 14. Analogous elements in the various figures are denoted by the same reference numerals. The apparatus 10 is a 102 mm diameter rocket equipped with a solid propellent motor 15 shown in dotted outline form having a slidable sleeve assembly 16, a payload section 17, a nose cone body 18 and a drive mechanism for the sleeve assembly identified generally with the numeral 20. The payload section 17 is defined by a movable wall 19 and rear fixed wall 22. The NEI elements 14 are loaded in the payload section 17 and are contained therein until the slidable sleeve assembly 16 is retracted uncovering the NEI elements 14 which are then propelled out from the payload section at a constant angular velocity in response to the centrifugal force generated by the spin rate of the rocket.

The manner of placement of the NEI elements within the payload section 17 provides advantages to the effectiveness of the apparatus. In one preferred embodiment (FIGS. 3 and 5) the NEI elements are charged randomly into the payload section 17. This is a less costly approach and upon deployment provides a randomly dispersed interceptor cloud. In another preferred embodiment (FIG. 2) the NEI elements are of a particular shape such as spheres or elongated rods and loaded into a series of rows of tubular structures extending radially about the longitudinal axis of the rocket. The advantage of the second preferred embodiment is the special configuration of the interceptor cloud generated by the controlled rate at which the NEI elements are propelled as well as the uniform weight distribution of the load in the rocket assuring more accurate control of its flight pattern. Both embodiments provide good kill success by the respective interceptor clouds.

Figure 2:
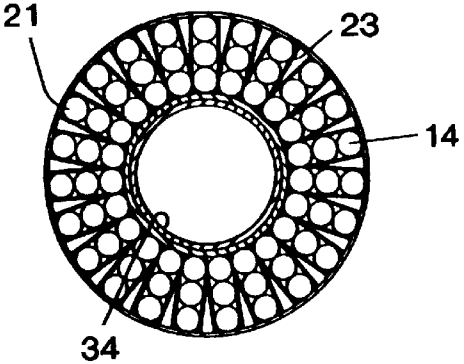
FIG. 2 is a cross-section taken through 2—2 of FIG. 1 showing the payload section and containment of the NEI elements.

As shown in FIGS. 1 and 2 the NEI elements 14 are loaded into a series of rows of radially extending tubes 23 or cylinders forming an array of columns of NEI elements arranged about the longitudinal axis 25 of the rocket. In the alternative preferred embodiment the NEI elements are randomly charged into the payload section 17 shown in FIG. 3. In either of the embodiments as the sleeve assembly 16 is driven in the direction of flight, portions of the loaded NEI elements are set free from containment within the payload section 17 forming an interceptor cloud of randomly deployed elements or and in the other embodiment in particular configuration.

Referring again to FIG. 1 there is shown a drive mechanism 20 which at the appropriate time is actuated causing the slidable sleeve assembly 16 to move in a direction from the rearward end 11 to the lead end 12 of the spin stabilized rocket 10. The slidable sleeve assembly 16 comprises a sleeve member 21 which is integrally affixed to and moves with the nose cone body 18. The support wall 19 has an annular opening 30 which is closed with a cup-shaped bracket 28. The drive mechanism 20 includes a drive cylinder 24 centrally mounted within the payload section 17, generally along the center longitudinal axis 25, and containing a drive rod 26. The drive rod 26 extends along the longitudinal axis 25 having one end 31 releasably supported in the rearward end 11 of the rocket and its forward end 32 affixed to the bracket 28. The bracket 28 also receives the forward end 29 of the drive cylinder 24. The support wall 19 extends transversely across the inside diameter of the rocket meeting the sleeve member 21 at the juncture 27 where it is secured to the nose cone body 18.

The sleeve member 21, the shell of the nose cone body 18 and the wall 19 are welded at the juncture 27 or otherwise integrated so that the assembly 16 moves as a unitary body.

A slide support casing 34 concentrically surrounds the drive cylinder 24. The casing 34 is diametrically larger than the drive cylinder 24 forming an annular space 36 therebetween. The slide support casing extends rearwardly through the payload section, its front end 37 fixed to the support wall 19, and the back end being unattached. The wall 19 is affixed to the slide support casing 34. The slide support casing 34 is slidably disposed within a fixed tube 35 that is part of the payload section 17 forming the bottom support for the NEI. With the slide support casing 34 affixed to the front support wall 19 it will slide within the fixed tube 35 toward the lead end 12 as the support wall is moved forward. In the space 36 formed between the slide support casing 34 there is compressively coiled about the drive cylinder 24, a spring unit 40 disposed between the bracket 28 and the rear fixed support wall 22 of the payload section 17. In the circumstance a greater driving force is required then provided by a coiled spring 40 an auxiliary mechanism may be provided in the form of a pyrotechnic device.

Figure 4:
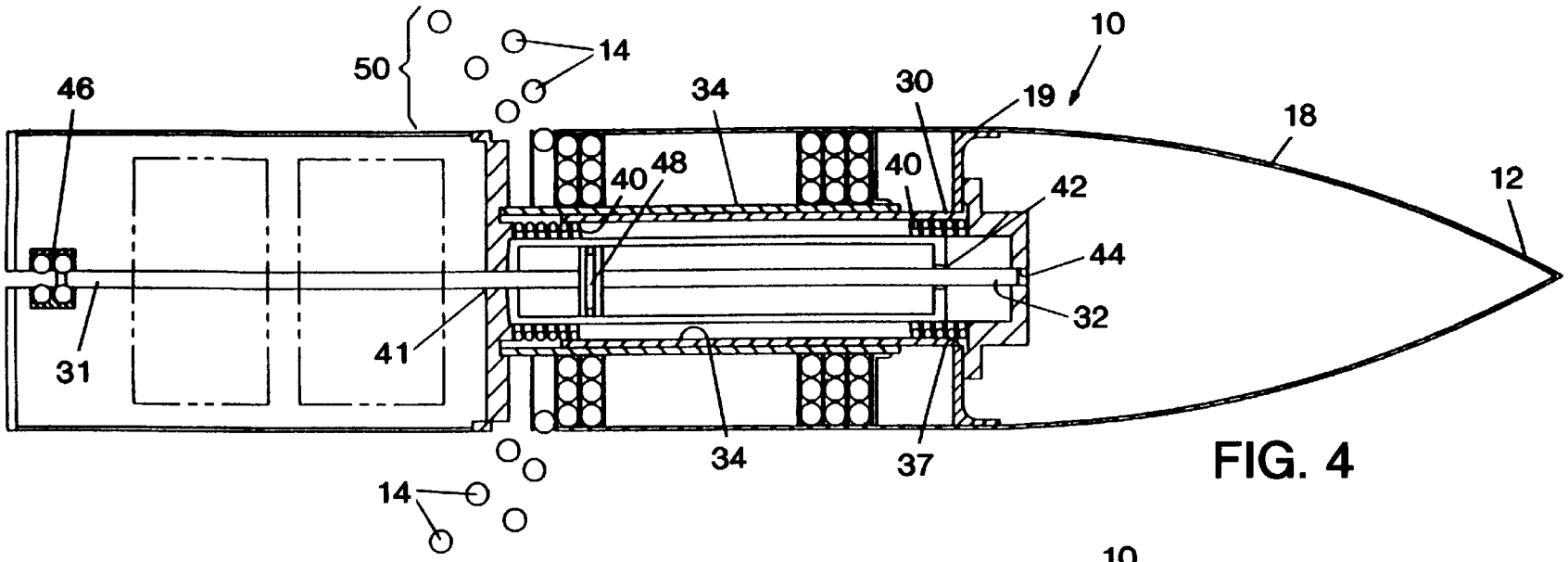
FIG. 4 is a longitudinal cross-section of the defending countermeasure rocket showing the slidable sleeve assembly driven in the direction of flight partially uncovering the stowed NEI elements showing the initial formation of the interceptor cloud.
Figure 5:
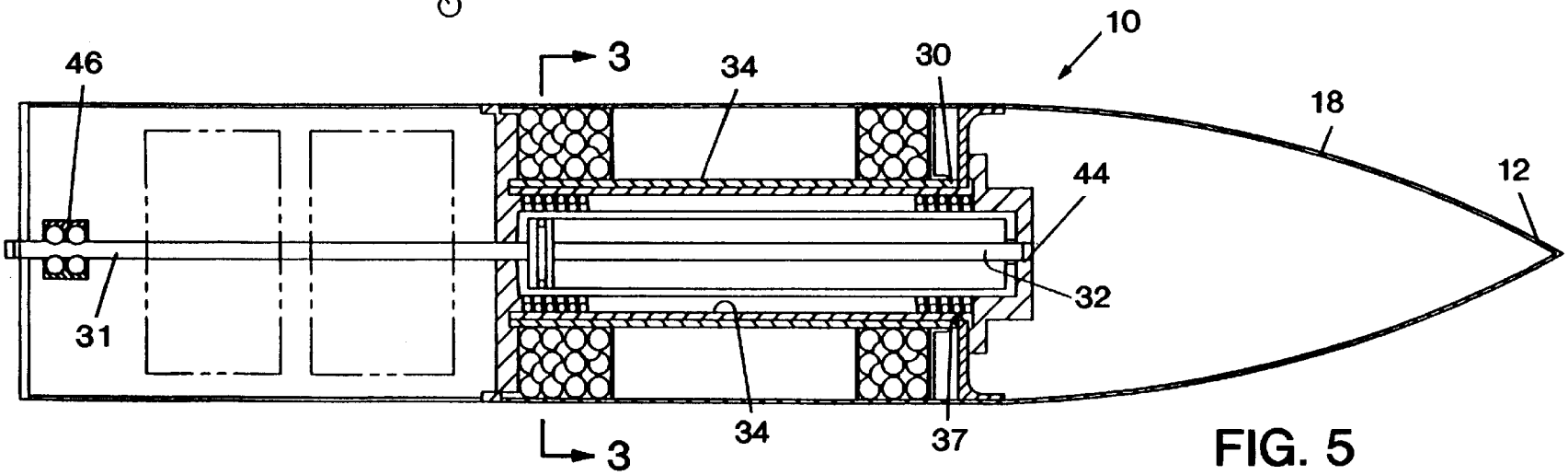
FIG. 5 is a longitudinal cross-section of the defending countermeasure rocket showing the sleeve assembly enclosing the randomly disposed NEI elements within the payload section.

Referring to FIGS. 4 and 5, there is shown running through center of the rocket 10 along the longitudinal axis 25 a drive rod 26 releasably secured at the rearward end 11 and extending into and through the drive cylinder 24 through the opening 41 and terminating at the other end of the drive cylinder 24 through opening 42 and secured to the bracket 28 within a notch 44. The back end of the drive rod 26 is releasably supported in the rearward end 11 of the rocket 10 and is locked in position by a trigger assembly 46.

Figure 3A:
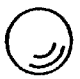
FIG. 3A is a sketch of a spherically shaped NEI.
Figure 3B:
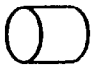
FIG. 3B is a sketch of a cylindrically shaped NEI.
Figure 3C:
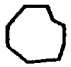
FIG. 3C is a sketch of an irregularly shaped NEI.
Figure 3:
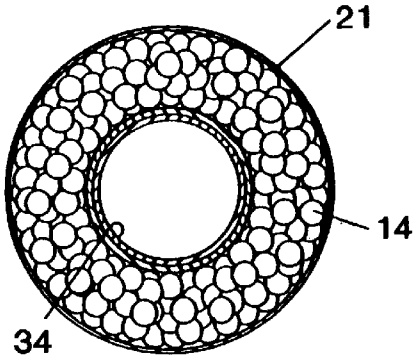
FIG. 3 is a cross-section view of the payload section with the NEI elements randomly loaded in the compartment taken through 3—3 of FIG. 5.

As shown in FIGS. 3 and 5, the NEI elements 14 are randomly loaded in the payload section 17. In contrast to the type of NEI cloud formation 50 that occurs when deploying the elements shown in FIG. 4, the randomly loaded elements 14 in FIG. 5 will form a continuous cloud of randomly dispersed elements 14. Deployment occurs in the same manner as described in connection with FIG. 4 except that the NEI elements are propelled out from the payload section in random fashion thereby forming a continuous interceptor cloud. The dimensions of the cloud are similar to that described in connection with FIG. 4.

The drive mechanism 20 is set to force the nose cone 18 and the sleeve member 21 to advance in the direction of the lead end 12 of the rocket by the biasing force of the coiled spring unit 40 biased against the ends of the cup-shaped bracket 28 which covers the annular opening 30 of the movable front payload wall 19. Within the drive cylinder 24 and affixed to the drive rod 26 is a dash pot 48 which serves to control the rate of movement of the drive rod 26 within the cylinder 24 that uncovers the payload section 17. It will be appreciated that the size and geometry of the continuous interceptor cloud of NEI can be controlled by the rate at which the sleeve member 21 unsheathes the payload section 17 centrifugally forcing out the NEI elements 14 in controlled cloud patterns. Rapid release in a short period of time of all of the NEI elements would create a rather condensed interceptor cloud and the slower the rate at which they are propelled out of the payload section 17 the more dispersed would be the continuous interceptor cloud.

Turning now to FIG. 4 there is shown the condition of the rocket 10 with the trigger assembly 46 having been actuated releasing the drive rod 26 thereby setting the sleeve assembly 16 in motion towards the lead end 12 of the rocket 10 exposing the initial arrays of NEI elements. The elements 14 are deployed by the centrifugal force of the spin stabilized rocket. Laboratory tests have demonstrated that the system will create a continuous cloud 50 of spherical interceptors. It will be appreciated that the NEI elements may be spherically shaped such as, for example, ball bearings of 5/16 inches in diameter or steel rods ¼ to ¾ inches long and 5/16 inches in diameter, dispersed in the trajectory path of the incoming hostile missile. In terms of time, for example, deployment takes place within the range of 256 to 512 milliseconds after launch.

Figure 6:
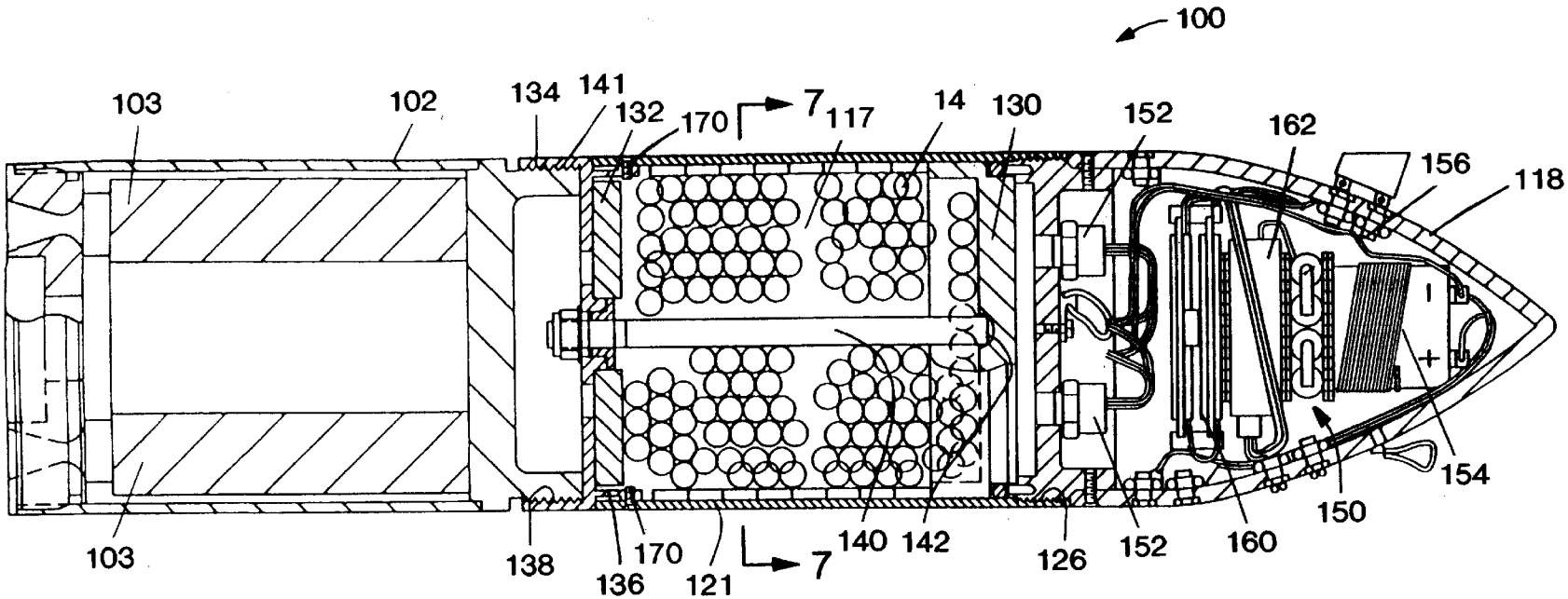
FIG. 6 is a longitudinal cross-section of a defending countermeasure rocket time delay control unit showing the releasable sleeve secured by shearable screws.
Figure 7:
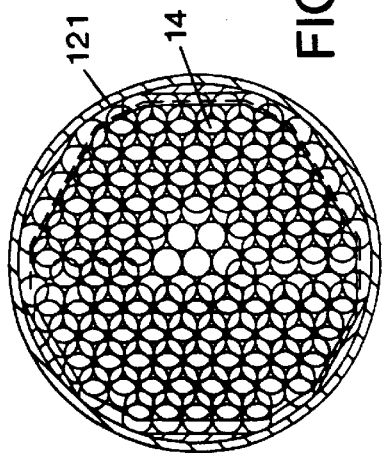
FIG. 7 is a cross-section taken along 7—7 of FIG. 6 showing the hexagonal stacking array of NEI.

In another preferred embodiment the rocket construction employs pyrotechnic unit for unsheathing the payload section to release the NEI. Referring to FIG. 6 the rocket is identified with the general reference numeral 100. The principal structures that comprise the rocket are the engine housing 102, which contains the rocket engine 103, the payload section 117 and the nose cone body 118.

The rocket motors disposed in the housing 102 are solid propellant engines which produce a nominal 1200 lbs of thrust and provides the rocket with 52 g's of acceleration and spin rate of about 10,000 to 11,000 rpm. The forward end of the housing 102 is equipped with a framed protective wall 120 formed with a cowling construction 122. The cowling 122 has the same diameter as the rocket engine housing 102 and it projects toward the payload section 117. The outside of the cowling 122 is threaded so that it may receive and be secured to the payload section 117 and the nose cone body 118.

The payload section 117 is formed within a sleeve member 121 that encloses the payload section 117 which contains the charge of NEI shown in FIGS. 3A, 3B and 3C. The payload section 117 and the nose cone body 118 are assembled by engaging the outside threads 127 of the nose cone with the inside threads 129 of the sleeve 121 forming the forward separable section 126 of the rocket 100. The front of the payload section 117 includes a fire wall 130 which confronts the back end of the nose cone section 118. The back end of the payload section 117 is enclosed with a support wall member 132 which serves to contain the NEI in the stacked condition. The support wall member 132 is affixed to a threaded bushing 134 formed with a flange portion 136 and an inside threaded portion 138. The rocket engine housing at the forward end has a protective wall 139 equipped with outside threaded flange portions 141. It will be appreciated that the entire forward section 126 and the rocket housing 102 can be threaded together by joining the threaded portions 141 and 134.

The payload section 117 includes a rod 140 that extends between fire wall 130 and the support wall member 132 being releasably held in the fire wall 130 at its center 142. The back end of the rod 140 is secured in the support wall 130 and the bushing 134 by being welded in place. As will be described hereinafter the rod 140 functions together with the fire wall 130 to effect separation of the forward section 126 of the rocket from the engine housing to release the NEI.

The nose cone section 118 contains the countdown delay timer control 150 and the pyrotechnic unit 152. As shown in FIG. 6 the countdown delay timing control 150 comprises a capacitor unit 154, batteries 156, a 9-channel radio controlled receiver 160, and a control circuit 162. The countdown delay timing control 150, the capacitor unit 154, the batteries 156, the 9-channel radio-controlled receiver 160 and the control circuit 162 collectively provide control means 163 for guiding the missile. It will be appreciated the countermeasure apparatus must do its work in a very narrow time window of milliseconds duration.

In practice the system responds to a radar tracking unit which is W-band 94 Ghz radar set. The radar is co-located with the launcher. The radar tracker is capable of picking up the hostile rocket at several hundred meters and to track it continuously providing range and target coordinates. This data is fed into the launcher signal processor that calculates the intercept aim point and the time of deployment of the NEI and calculates the time delay before the pyrotechnic unit is actuated from the time of launch. The operation of the time delay control circuit is initiated concurrently with the launch of the countermeasure rocket.

The initial time delay countdown can be updated. In the updating mode the radar processor sends commands to a radio controlled receiver 160 on board the rocket which converts the digital command to a series of pulses which are demodulated and decoded by the circuit 162. Pyrotechnic devices are fired when the radar tracking signals compare or match the updated decoded data.

The section 126 is held in place against the threaded bushing 134 by screws 170 that are designed to shear in response to the force of the pyrotechnic devices 152. At the instant the time delay control 150 and the predetermined or updated time delay expires the capacitor units 154, powered by the battery set 156, fires the pyrotechnic devices 152 which exerts sufficient explosive force against the wall 130 urging the nose cone section 118 to pull the payload section 117 forward. The explosive force is transmitted from the wall 130 to the rod 140 which is secured to the flange 136 of the bushing 134, shearing the screws 170. The explosive force causes the entire forward section 126 to separate from the engine housing 102 exposing the NEI to the centrifugal force of the spinning counter measure rocket.

The NEI are forced out of the payload section as described earlier creating a cloud of interceptor elements as shown in FIG. 4.

In the event the initial array of NEI elements fail to engage the target the subsequent elements in the remaining cloud will likely strike the missile. Within fractions of a second after deployment the entire cloud will have spent its discharge energy from the rocket and begin to fall harmlessly to the earth. In most instances a single interceptor element striking the incoming missile could cause a kill. It will be appreciated that the only explosive elements occurring in the engagement would be that of the hostile missile kill thereby reducing and possibly minimizing the hazard to friendly military personnel on the ground beneath the engagement.

It will be appreciated that there are no munitions or sub-munitions in the countermeasure, the need for "safe and arm" devices is obviated. The inherent danger to personnel loading the round into the rocket or otherwise handling this device, is greatly reduced.

In the event that the countermeasure missile completely misses its target it will ultimately fall to earth but poses no hazard since it contains no unexploded or undetanoted cargo. This invention avoids the circumstance of the countermeasure missile being armed with explosives such that the expiration of the time delay could, by itself, cause an explosion in mid-air and pose a hazard. The use of heavy metals or shrapnel-like elements that are deployed by an explosive force pose a hazard to friendly military personnel.

Although the present invention has been described in considerable detail with reference to certain preferred versions thereof, other versions are possible. Therefore, the scope of the appended claims should not be limited to the description of the preferred versions contained herein.

What is claimed is:

1. A method for destroying an incoming hostile missile comprising the steps of:

a) launching a countermeasure spin stabilized defense rocket carrying non-explosive interceptor (NEI) elements to form a cloud of said NEI elements for destroying the incoming hostile missile, the stabilized defense rocket comprising:
   a rocket engine housing;
   control means for aiming the rocket along an intercepting path;
   containment means for containment of said NEI elements during flight, said containment means comprising a payload section containing a supply of said NEI elements;
   deployment means for radially deploying the NEI elements at a predetermined time after launch, said deployment means comprising drive means for operating the containment means to set the NEI elements free of containment by only the centrifugal force generated by the spin stabilized rocket, and
   time control means for activating the drive means;

b) employing the control means to aim the rocket along the intercepting path;
   and c) employing the time control means and the deployment means to set the NEI elements free of containment by only the centrifugal force generated by the spin stabilized rocket and to thereby form a cloud of the NEI elements in the path of the incoming hostile missile;
   whereby the incoming hostile missile is destroyed by impact forces generated by the interaction between the hostile incoming missile and the NEI elements.

2. The method as claimed in claim 1 wherein the drive means is a pyrotechnic device generating an explosive force.

3. The method as claimed in claim 1 wherein the NEI elements are spherical in shape.

4. The method as claimed in claim 1 wherein the NEI elements are elongated rods.

5. The method as claimed in claim 1 wherein the NEI elements are irregular in shape.

6. The method as claimed in claim 1 wherein the deployment of the NEI elements are propelled outward from the payload section at a constant tangential velocity forming a continuous cloud of said elements in the intercepting path of the incoming hostile missile.

7. The method as claimed in claim 1 wherein the containment means comprises a sleeve assembly releasably attached to the rocket engine housing with fasteners that become detached in response to an explosive force actuated by the time control means.

8. The method as claimed in claim 1 wherein the time control means is a time delay device preset at the time the rocket is launched.

9. The method as claimed in claim 1 wherein the rocket is propelled by solid propellent.

10. A countermeasure defense spin stabilized rocket adapted to intercept an incoming hostile missile along an interception path employing NEI elements that are propelled by the centrifugal force of the spinning rocket having a rearward end and a nose cone, said rocket comprising:

a) rocket housing at the rearward end;

b) a payload section charged with a supply of NEI elements to be deployed by only the centrifugal force generated by the spin stabilized rocket at a point intersecting said interception path, said payload section contained within a sleeve member;

c) a nose cone section equipped with a pyrotechnic device for generating an explosive force and a countdown time delay control unit for activating said pyrotechnic device at the expiration of said delay time;

d) a controller for controlling the spin stabilized rocket along the interception path and for detonating the pyrotechnic device when the spin stabilized rocket approaches the incoming hostile missile; and e) fastener means releasably attaching the sleeve member to the rocket housing, said fasteners becoming detached in response to the explosive force generated by the pyrotechnic device at the expiration of said delayed time;

whereby, when the pyrotechnic device is activated, the fastener means is detached causing said sleeve member and nose cone to become separated from the rocket housing allowing the NEI elements within the payload section to exit the sleeve member, whereupon the NEI elements are propelled radially outwardly by only the centrifugal force of the spinning rocket to create an interceptor cloud.

11. The invention as claimed in claim 10 wherein said fastener means are shearable screws.

12. The invention as claimed in claim 10 wherein the countdown period of the time delay control is initiated simultaneously with the launch of the rocket.

13. The invention as claimed in claim 10 wherein the payload section is separated from the nose cone section by a fire wall and the rocket housing is separated from the payload section with a support wall.

14. The invention as claimed in claim 13 wherein the payload section is constructed with a rod member extending axially between the fire wall and the support wall.

15. The invention as claimed in claim 13 wherein the pyrotechnic device is disposed adjacent the fire wall.

16. The invention as claimed in claim 14 wherein the rod member is fixed to the support wall and releasably disposed against the fire wall.

* * * * *